US010744356B2

(12) United States Patent
Livchak et al.

(10) Patent No.: US 10,744,356 B2
(45) **Date of Patent: *Aug. 18, 2020**

(54) FIRE SUPPRESSION SYSTEMS, DEVICES, AND METHODS

(71) Applicant: Oy Halton Group Ltd., Helsinki (FI)

(72) Inventors: Andrey V. Livchak, Bowling Green, KY (US); Rick A. Bagwell, Scottsville, KY (US); Philip J. Meredith, Alvaton, KY (US); Derek W. Schrock, Bowling Green, KY (US)

(73) Assignee: Oy Halton Group Ltd., Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 16/572,666

(22) Filed: Sep. 17, 2019

(65) Prior Publication Data

US 2020/0023214 A1 Jan. 23, 2020

Related U.S. Application Data

(63) Continuation of application No. 15/585,062, filed on May 2, 2017, now Pat. No. 10,434,344, which is a (Continued)

(51) Int. Cl.
*A62C 3/00* (2006.01)
*A62C 37/36* (2006.01)
(Continued)

(52) U.S. Cl.
CPC ..... *A62C 3/006* (2013.01); *A62C 37/36* (2013.01); *A62C 37/40* (2013.01); *F24C 15/2021* (2013.01)

(58) Field of Classification Search
CPC ..... A62C 3/006; A62C 37/36; F24F 11/0012; F24F 2011/0042; F24C 15/2021
See application file for complete search history.

(56) References Cited

U.S. PATENT DOCUMENTS 5,642,784 A * 7/1997 Guay ..... A62C 3/04 169/61
6,170,480 B1 * 1/2001 Melink ..... F24C 15/2021 126/299 D (Continued)

FOREIGN PATENT DOCUMENTS

CL 200200243 2/2002
CN 201141651 10/2008

(Continued)

OTHER PUBLICATIONS

EPO Search Report for EP 13823890.2 dated Feb. 8, 2016.

(Continued)

*Primary Examiner* — Ryan A Reis
(74) *Attorney, Agent, or Firm* — Potomac Law Group, PLLC; George Dolina

(57) ABSTRACT

A method of responding to a condition in an exhaust ventilation system that has an exhaust hood includes receiving, at a control module, an exhaust air temperature signal representing a temperature of the exhaust air in a vicinity of the exhaust hood, the exhaust air temperature signal being generated by a temperature sensor. The method also includes receiving a radiant temperature signal representing a temperature of a surface of a cooking appliance that generates the exhaust air, the radiant temperature signal being generated by a radiant temperature sensor. Further, the method includes receiving a pressure signal representing the pressure in the hood and determining a state of the cooking appliance based on the received exhaust air temperature signal, the received radiant temperature signal, and the received pressure signal. Finally, the method responds to the determined appliance state by outputting a control signal from the control module.

15 Claims, 4 Drawing Sheets

Related U.S. Application Data continuation of application No. 14/406,185, filed as application No. PCT/US2013/044839 on Jun. 7, 2013, now Pat. No. 9,662,519.

(60) Provisional application No. 61/656,941, filed on Jun. 7, 2012.

(51) Int. Cl.
*F24C 15/20* (2006.01)
*A62C 37/40* (2006.01)

(56) References Cited

U.S. PATENT DOCUMENTS

| | | | | |
|---|---|---|---|---|
| 6,515,283 | B1 * | 2/2003 | Castleman | G08B 17/12 250/339.15 |
| 6,920,874 | B1 * | 7/2005 | Siegel | F24C 15/2021 126/21 A |
| 9,662,519 | B2 * | 5/2017 | Livchak | F24C 15/2021 |
| 10,434,344 | B2 * | 10/2019 | Livchak | A62C 3/006 |
| 2003/0206572 | A1 * | 11/2003 | Dorwarth | H05B 3/746 374/121 |
| 2005/0156053 | A1 * | 7/2005 | Melink | F24C 15/2021 236/49.3 |
| 2006/0032492 | A1 * | 2/2006 | Bagwell | F15D 1/02 126/299 R |
| 2009/0061752 | A1 | 3/2009 | Burdett et al. | |
| 2010/0319551 | A1 | 12/2010 | Cox et al. | |
| 2011/0005507 | A9 | 1/2011 | Bagwell et al. | |
| 2011/0134413 | A1 * | 6/2011 | Has | F24C 15/2021 356/51 |
| 2011/0253693 | A1 * | 10/2011 | Lyons | A47J 27/00 219/209 |
| 2011/0284091 | A1 * | 11/2011 | Livchak | F24C 15/2021 137/2 |
| 2012/0055275 | A1 * | 3/2012 | Lambertson | F24C 15/2021 73/866.5 |
| 2013/0187781 | A1 * | 7/2013 | Bach | F24C 15/2021 340/584 |

FOREIGN PATENT DOCUMENTS

| | | | |
|---|---|---|---|
| CN | 101592348 | A | 12/2009 |
| CN | 202018077 | U | 10/2011 |
| CN | 102301187 | A | 12/2011 |
| JP | S55125349 | | 9/1980 |
| JP | H03079947 | A | 4/1991 |
| JP | 2000304315 | A | 11/2000 |
| JP | 2012511138 | A | 5/2012 |
| KR | 19960024044 | | 7/1996 |
| WO | 2006009125 | A1 | 9/2006 |
| WO | 2006099125 | A2 | 9/2006 |
| WO | 2009004332 | A2 | 1/2009 |
| WO | 2010065793 | A1 | 6/2010 |

OTHER PUBLICATIONS

Examination Report for European Patent Application No. 13823890.2 dated May 9, 2017.
Examination Report for United Kingdom Patent Application No. 1423118.7 dated May 25, 2016.
Extended European Search Report for European Patent Application No. 18158841.9 dated Jun. 11, 2018.
International Preliminary Report of Patentablity and/or Written Opinion dated Dec. 9, 2014, for International Application No. PCT/US2013/044839.
International Search Report and Written Opinion, dated Nov. 8, 2013, for International Application No. PCT/US2013/044839.
Notice of Preliminary Rejection for South Korean Patent Application No. 2015-7000178 dated May 30, 2018 (with translation).
Office Action (Examination Report No. 1) dated May 1, 2019 for Australian Patent Application No. 2018201603.
Office Action for Australian Patent Application No. 2013234030 dated Mar. 24, 2017.
Office Action for Chile Patent Application No. 3330-2014 dated Feb. 29, 2016.
Office Action for Chilean Patent Application No. 3330-2014 dated Dec. 1, 2016 (with agent's English language summary).
Office Action for China Patent Application No. 201380042082.X dated Mar. 3, 2016.
Office Action for Chinese Patent Application No. 201380042082.X dated Oct. 25, 2016 (with English language translation).
Office Action for Columbian Patent Application No. 14-279.246 dated Sep. 6, 2016 (English language translation only).
Office Action for Japanese Patent Application No. 2015-516263 dated Jan. 31, 2017 (includes English language translation).
Office Action dated Jan. 19, 2015, in UK Patent Application No. GB14723118.7.
Office Action dated Jan. 23, 2019 for Peruvian Patent Application No. 002384-2014/DIN.
EP Communication pursuant to Article 94(3) issued in EP application No. 18158841.9 and dated May 12, 2020.

* cited by examiner

FIRE SUPPRESSION SYSTEMS, DEVICES, AND METHODS

RELATED APPLICATIONS

The present application is a continuation of U.S. application Ser. No. 15/585,062, filed May 2, 2017, which is a continuation of U.S. application Ser. No. 14/406,185, filed Dec. 5, 2014, which is a national stage entry of International Application No. PCT/US2013/044839, filed Jun. 7, 2013, which claims the benefit of U.S. Provisional Application No. 61/656,941, filed Jun. 7, 2012, all of which are incorporated herein by reference in their entireties.

FIELD

Embodiments of the present invention relate generally to exhaust control systems, devices and methods including fire suppression. More specifically, embodiments relate to systems, devices, and methods for determining whether a fire condition exists based on a status of a cooking appliance and for controlling exhaust rate to ensure minimal excess air exhaust while ensuring capture and containment of an exhaust hood.

BACKGROUND

Known fire suppression systems used in hoods placed over cook-stoves or ranges are mainly concerned with delivering fire retardant onto the cooking surface to stop fat or grease fires when a temperature indicative of a fire is measured in the hood plenum or ductwork. The existing fire suppression systems operate by measuring a fixed absolute temperature in the hood plenum or the ductwork and either activating an alarm or the release of fire retardant when a previously set temperature has been reached. This type of approach, however, does not account for changes in the exhaust temperature, nor does it account for scenarios where there is only a flare-up from regular cooking, instead of a fire.

SUMMARY

In embodiments, network-based, or rule-based, methods combine multiple sensor inputs to generate a status indication which is used to control fire suppression and exhaust flow by a single set of sensor inputs. In embodiments, at least one sensor type generating a predefined signal is used to detect fire condition and appliance cooking state, the predefined signal being applied to a controller which differentiates, responsively the predefined signal, in combination with other sensor signals, at least two cooking states each of the cooking states corresponding to at least two exhaust flow rates which the controller implements in response to the controller's differentiation of the two states and which predefined signal is simultaneously used to differentiate a fire condition, in response to the differentiation of which, the same controller activates a fire suppression mechanism such as a water spray or chemical fire extinguisher.

One or more embodiments include systems and methods for suppressing fire responsively to a determination that a fire condition exists.

One or more embodiments include systems and methods for determining whether a fire condition exists based on an evaluation of a heat gain from a cooking appliance in addition to measuring the exhaust hood temperature.

One or more embodiments include a system and method for determining if there is a fire or a flare-up from regular cooking.

One or more embodiments include systems and methods for determining whether a fire condition exist based on detection of instantaneous heat emitted from the cooking appliance and the measurement of the rate of change of the cooking appliance heat.

In embodiments the detection of the instantaneous heat may be based on airflow measurements.

The airflow measurement and subsequent exhaust flow rate control may include the airflow measurement and exhaust flow rate control, for example as described in detail in United States Patent Application 20110284091, incorporated herein by reference as if fully set forth in its entirety herein.

One or more embodiments include a system and method for fire condition determination and fire suppression control in an exhaust ventilation system positioned above one or more cooking appliances. The system and method may include determining whether a fire condition exists based on a determination of the appliance status. The appliance status may include a cooking state, an idle state, a flare-up state, a fire state, an off state, and other states.

Determining the appliance status may include measuring a temperature of the exhaust air in the vicinity of the exhaust hood, measuring a radiant temperature of the exhaust air in the vicinity of the cooking appliance, determining a total heat gain from the cooking appliance, determining a total duration of the heat gain, and determining an appliance status based on the measured exhaust air temperature, radiant temperature, the total heat gain, and the total duration of the heat gain.

The exhaust air temperature near the vicinity of the exhaust hood may be measured using a temperature sensor.

In embodiments the radiant temperature in the vicinity of the cooking appliance is measured using an infrared (IR) sensor.

In a cooking state it may be determined that there is a fluctuation in the radiant temperature and the mean radiant temperature of the cooking appliance, or that the exhaust temperature is above a minimum exhaust temperature.

In an idle state it may be determined that there is no radiant temperature fluctuation for the duration of the cooking time and the exhaust temperature is less than a predetermined minimum exhaust temperature.

In a flare-up state it may be determined that a measured total heat gain from the cooking appliances is less than a predetermined threshold heat gain or that the total heat gain is above the predetermined threshold heat gain and the duration of the heat gain is less than a predetermined threshold duration.

In a fire state it may be determined that the total heat gain is above the predetermined threshold heat gain and the duration of the heat gain is above the predetermined threshold duration.

In an OFF state, it may be determined that the mean radiant temperature is less than a predetermined minimum radiant temperature and that the exhaust temperature is less than a predetermined ambient air temperature plus the mean ambient air temperature of the space in the vicinity of the cooking appliance.

Embodiments may further comprise controlling the exhaust air flow rate in an exhaust ventilation system positioned above a cooking appliance where the exhaust air flow is controlled by turning the fan on or off, or by changing the fan speed and the damper position based on the determined appliance status.

Embodiments may further include activating a fire suppression source in a fire suppressing system based on the detected appliance status.

In embodiments a fire suppression source is turned on or off based on a detected appliance status. In embodiments, when the appliance status is determined to be in a fire state, the fire retardant source is turned on. In embodiments, when the appliance status is determined to be in any other state (off, idle, cooking, or flare-up), the fire retardant source is not turned on.

Embodiments may further comprise controlling the exhaust air flow rate in an exhaust ventilation system positioned above a cooking appliance where the exhaust flow rate is changed based on a change in the appliance status.

Embodiments may further comprise an exhaust ventilation system including an exhaust hood mounted above a cooking appliance with an exhaust fan for removing exhaust air generated by the cooking appliance, at least one sensor for measuring a radiant temperature of the cooking appliance, at least one temperature sensor attached to the exhaust hood (in the hood plenum or ductwork, for example) for measuring the temperature of the exhaust air, and a control module to determine a status of the cooking appliance based on the measured radiant temperature, the exhaust air temperature, the total heat gain from the radiant heat emitted by the cooking appliance, and the duration of the heat gain, and to control an exhaust air flow rate and activation of a fire suppressing system based on the appliance status.

Embodiments may further comprise a control module that controls the exhaust air flow rate by controlling a speed of an exhaust fan, and at least one motorized balancing damper attached to the exhaust hood to control a volume of the exhaust air that enters a hood duct.

In various embodiments the control module may further control the exhaust air flow rate by controlling a position of the at least one motorized balancing damper.

Embodiments may further comprise a control module that controls activation of a fire suppression (extinguishing) system when the appliance is determined to be in a fire state. When the fire suppression system is activated, a fire retardant is sprayed from a fire suppression source included in the fire suppression system through one or more nozzles included in the exhaust ventilation system.

An embodiment may include a method of detecting a condition in an exhaust ventilation system including an exhaust hood, the method comprising: receiving, at a control module, an exhaust air temperature signal representing a temperature of the exhaust air in a vicinity of the exhaust hood, the exhaust air temperature signal being generated by a temperature sensor; receiving, at the control module, a radiant temperature signal representing a temperature of a surface of a cooking appliance that generates the exhaust air, the radiant temperature signal being generated by a radiant temperature sensor; receiving, at the control module, a pressure signal representing the pressure in the hood; determining in the control module a state of the cooking appliance based on the received exhaust air temperature signal, the received radiant temperature signal, and the received pressure signal; and determining a fire condition in response to the determined appliance state.

The cooking appliance state may include a cooking state, an idle state, an off state, a flare-up state, and a fire state.

The determining may further include determining a fluctuation in the radiant temperature, a rate of radiant heat change, a total radiant heat gain, and a duration of the rate of radiant heat change.

The cooking appliance may be determined to be in the cooking state when there is a fluctuation in the radiant temperature and the radiant temperature is greater than a predetermined minimum radiant temperature, the cooking appliance is determined to be in the idle state when no fluctuation in the radiant temperature is determined, the cooking appliance is determined to be in the off state when there is no fluctuation in the radiant temperature and the radiant temperature is less than a predetermined minimum radiant temperature, the cooking appliance is determined to be in the flare-up state when total radiant heat gain from the cooking appliance is less than a predetermined threshold gain or when the total heat gain is above the predetermined threshold heat gain and the duration of the heat gain is less than a predetermined threshold duration, and the cooking appliance is determined to be in a fire state when the total heat gain is above the predetermined gain threshold and the duration of the heat gain is above the predetermined duration threshold.

When a fire state is determined, a fire suppression system may be activated to extinguish the fire.

When an idle, a cooking, an OFF, or a flare-up state is determined, the control module may output a signal to a balancing damper and/or an exhaust fan to adjust an exhaust flow rate in the exhaust ventilation system.

Another embodiment may include a method of responding to a condition in an exhaust ventilation system including an exhaust hood, the method comprising: receiving, at a control module, an exhaust air temperature signal representing a temperature of the exhaust air in a vicinity of the exhaust hood, the exhaust air temperature signal being generated by a temperature sensor; receiving, at the control module, a radiant temperature signal representing a temperature of a surface of a cooking appliance that generates the exhaust air, the radiant temperature signal being generated by a radiant temperature sensor; receiving, at the control module, a pressure signal representing the pressure in the exhaust hood; determining in the control module a state of the cooking appliance based on the received exhaust air temperature signal, the received radiant temperature signal, and the received pressure signal; and responding to the determined appliance state by outputting a control signal from the control module.

The responding may include outputting a signal to a balancing damper and/or an exhaust fan to adjust an exhaust flow rate in the exhaust ventilation system when the cooking appliance state is determined to be one of the idle, cooking, OFF, and flare-up states, and activating a fire suppression system when the cooking appliance state is determined to be the fire state.

Another embodiment may include a fire detection system for cooking applications including an exhaust hood and at least a first and a second sensing device, the first sensing device measuring a surface temperature of a cooking appliance positioned under the exhaust hood and the second sensing device measuring a hood exhaust temperature.

The detection may include detecting and differentiating between intermediate flair-ups associated with a regular cooking process and a fire by detecting two thresholds of fire.

The system may further comprise (include) an airflow sensor to measure hood exhaust airflow.

The detection may further include measuring heat generated by the cooking appliance and a rate of change of the appliance heat.

Further, a system that evaluates the heat generated by the cooking appliances to determine if a fire has occurred is also disclosed.

The system may use infrared sensors to measure the appliance heat being emitted.

The system may also use pressure measurements to determine exhaust airflows.

DETAILED DESCRIPTION

Figure 1:
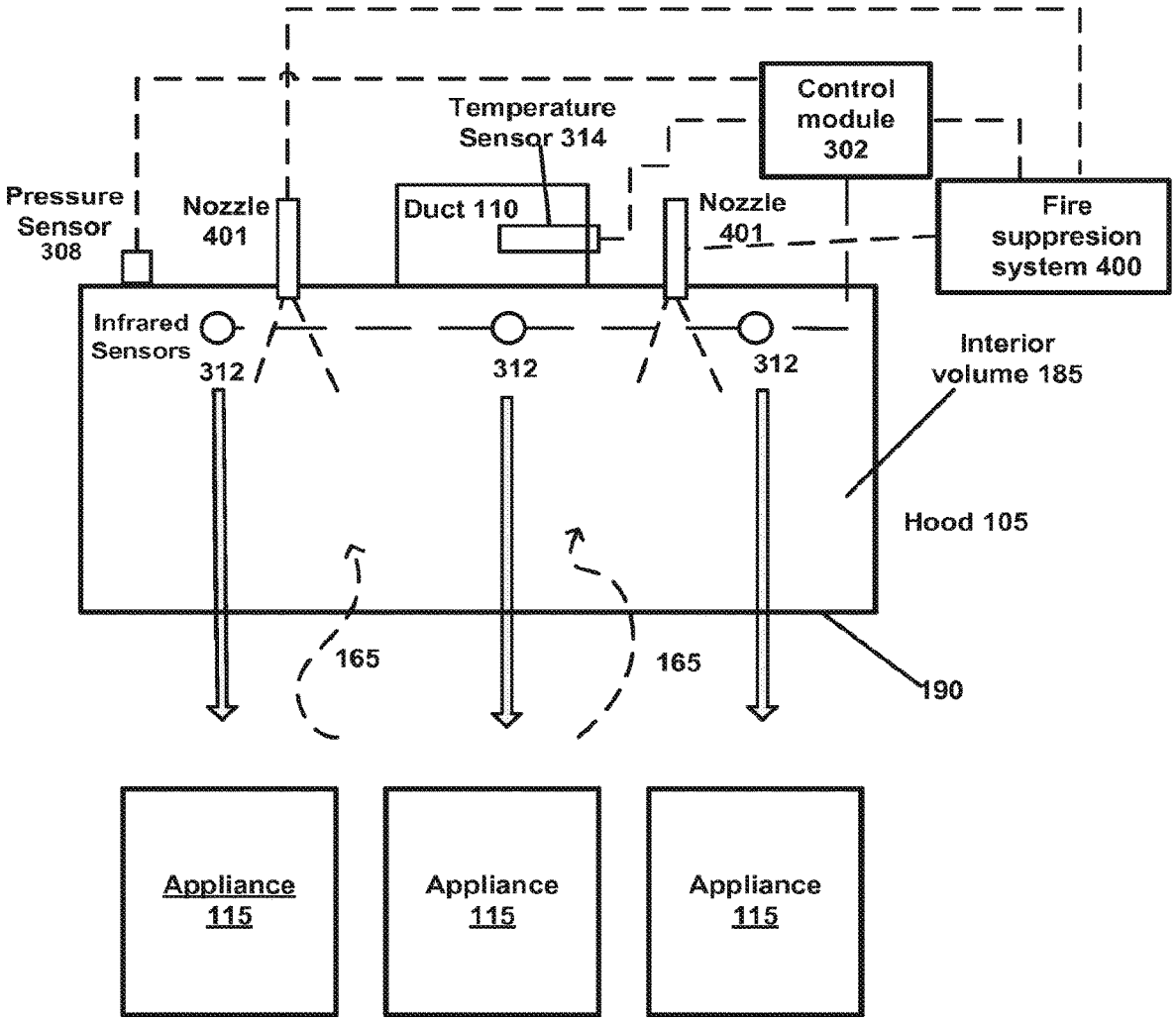
FIG. 1 is a perspective view diagrammatically illustrating an exhaust ventilating system positioned above cooking appliances and having a fire suppressing control system according to various embodiments.

Referring to FIG. 1, there is shown an exemplary exhaust ventilation system 100 including an exhaust hood 105 positioned above a plurality of cooking appliances 115 and provided in communication with an exhaust assembly (not shown) through an exhaust duct 110. A bottom opening of the exhaust hood 105 may be generally rectangular but may have any other desired shape. Walls of the hood 105 define an interior volume 185, which communicates with a downwardly facing bottom opening 190 at an end of the hood 105 that is positioned over the cooking appliances 115. The interior volume 185 may also communicate with the exhaust assembly through the exhaust duct 110. The exhaust duct 110 may extend upwardly toward the outside venting environment through the exhaust assembly.

The exhaust assembly may include a motorized exhaust fan (not shown), by which the exhaust air generated by the cooking appliances 115 is drawn into the exhaust duct 110 and for expelling into the outside venting environment. When the motor of the exhaust fan is running, an exhaust air flow path 165 is established between the cooking appliances 115 and the outside venting environment. As the air is pulled away from the cook top area, fumes, air pollutants and other air particles are exhausted into the outside venting environment through the exhaust duct 110 and exhaust assembly. One or more pressure sensors 308 may also be included in the system 100 to measure the static pressure in the main exhaust duct, as well as a plurality of grease removing filters (not shown) at the exhaust hood 105 bottom opening 190 to remove grease and fume particles from entering the hood exhaust duct 110.

The exhaust ventilating system 100 may further include a control module 302 which preferably includes a programmable processor 304 that is operably coupled to, and receives data from, a plurality of sensors and is configured to control the speed of the motorized exhaust fan, which in turn regulates the exhaust air flow rate in the system 100. The control module 302 communicates with the motorized exhaust fan which includes a speed control module such as a variable frequency drive (VFD) to control the speed of the motor, as well as one or more motorized balancing dampers (not shown) positioned near the exhaust duct 110.

The control module 302 is also configured to control activation and deactivation of a fire suppression mechanism 400 based on the detected cooking appliance status. The control module 302 controls the exhaust fan speed and the activation of the fire suppression mechanism 400 based on the output of a temperature sensor 314 positioned on or in the interior of the exhaust duct 110, and the output of infrared (IR) radiant temperature sensors 312, each positioned to face an upper surface of a respective cooking appliance 115. In at least one embodiment, three IR sensors 312 may be provided, each one positioned above a respective cooking appliance 115, so that each IR sensor 312 faces a respective cooking surface 115. However, any number and type of IR sensors 312 and any number of cooking appliances 115 may be used, as long as the radiant temperature of each cooking surface is detected. The control module 302 communicates with sensors 314 and 312 and identifies the cooking appliance status based on the sensor readings. The status of the cooking appliances 115 is determined based on the exhaust air temperature and the radiant temperature sensed using these multiple detectors.

Note that radiant temperature sensors may include, or be supplemented by one or more IR cameras and one or more optical cameras. A single camera may produce "color" channel of a video signal to allow a single video stream to indicate temperature and luminance at a large number of locations in real time. In fact a single video camera detecting IR color and optical bands may replace all of the radiant temperature sensors 312. The combination of optical and IR signals can be particularly useful in combination. For example a high sustained infrared signal without an contemporaneous optical signal may be classified by a controller as a hot grill while the same IR signal coupled with a strong or fluctuating optical signal may be classified as a fire. The spatial information provided by a camera may further aid in the disambiguation of combined signals.

Images, optical, IR or both may be image-processed to generate a state vector of reduced dimensionality as an input for training and recognizing fire and cooking events. Many examples of normal cooking and fire conditions may be used to train a supervised learning algorithm which may then may be used to recognize and classify, respectively, normal cooking and fire conditions.

Note that any of the embodiments may be modified by including fire control nozzles that have fusible links. In such an embodiment, a fusible link sprinkler head may be provided with a parallel feed that is controlled by a control valve for the fire suppression system. In the event of a failure of the control system, the fusible link can open its parallel supply of water causing water to be sprayed on the enabling heat source, presumably a fire.

The fire suppression mechanism 400 may include, store, and/or regulate the flow of, a fire control section including any known fire retardant material source capable of extinguish fire. Fire suppression mechanism 400 may further include a section that communicates with a digital network that interconnects other systems that control and/or indicate status information regarding, ventilation fans, filters, lighting, ductwork, cooking appliances, food order-taking, invoicing, inventory, public address, and/or any other components. For example, a signal may be generated on such a network to notify occupants and/or fire-fighting agencies of a detected fire condition, in addition to the activation of the fire suppression process.

Although shown as separate elements, nozzles 401 may be integral with the fire suppression mechanism 400. The structure illustrated may be one in which one or more separate nozzles are connected to the fire suppression mechanism 400 by fluid channels. Nozzles 401 may be strategically placed inside of the ventilation system 100 so as to be able to extinguish the fire regardless of its source. For example, one or more nozzles 401 may be placed in the plenum or grease collection area and one or more nozzles 401 may be positioned directly above the cooking appliance 115. The nozzles 401 communicate directly with the fire control section of the fire suppression mechanism 400 so that when the mechanism 400 is activated by the control module 302, fire retardant material is discharged through the nozzles 401. The fire retardant may be any known fire extinguishing material, such as, but not limited to water, or liquid potassium salt solution.

The control module 302 may determine a cooking appliance status (AS) based on the exhaust temperature sensor 314 and the IR radiant temperature sensor 312 outputs, and may change the exhaust fan speed as well as the position of the motorized balancing dampers in response to the determined cooking appliance status (AS). The control module 302 may also activate the fire suppression mechanism 400 based on a detected appliance status.

In one embodiment, a control system is adapted for regulation of exhaust flow rate responsively to a radiant temperature sensor. A first indication signal is generated if multiple cycles of high and low temperatures are indicated at one or more locations on a surface of the cooking appliance within a timer interval with a predefined temporal profile. This fluctuating radiant temperature regime is explained in United States Patent Application 20110284091. I and may serve as an indicator of high cooking state to which the control system responds by maintaining a high exhaust volume rate. Fire can be recognized by a signature of paroxysmal and sustained intervals of high radiant temperature. This rapid rise of radiant temperature may be discriminated using a high pass filter (digital post-processing or analog prefilter) applied to the radiant temperature input. The sustained feature of the fire event may be derived from a low pass filter component of the filtered radiant temperature. Another discriminator of grease fires from simply the hot radiant temperature signal of a grill which is on but not covered with food is that a grease fire may have, under certain circumstances, a lower radiant temperature because of a slower combustion owing to the lower efficiency of oxygen mixing in such a fire as compared to the burners of a grill. Another feature that may be used to distinguish a radiant grill from a fire is an optical component. An optical imaging device employed along with the radiant temperature sensor may generate images that can be digital processed to identify a fire and distinguish it from a hot grill operating in normal conditions.

Figure 4:
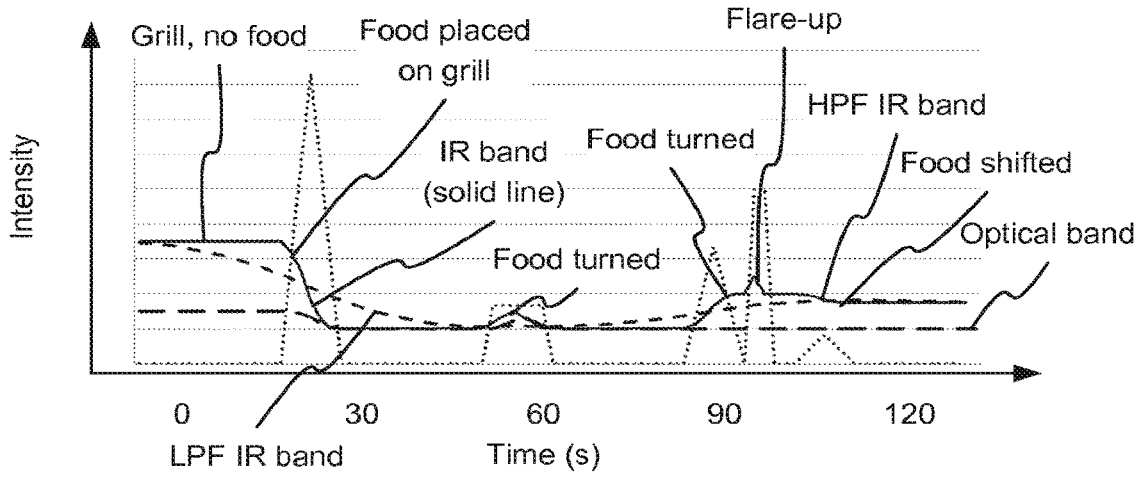
FIG. 4 illustrates, using simulated data, a time, light intensity profile for IR and optical bands filtered and unfiltered in a cooking scenario.

Referring to FIG. 4, a radiation intensity versus time graph from simulated data shows radiant temperature, optical intensity, and high and low passed filtered versions of the radiant temperature over an interval of time during in which the sensors detect a bare hot grill with no food, then food is placed on the hot grill, then the food is turned once and then again. The signal resulting from high-pass filtering (HPF) the IR intensity indicates a sudden changes from turning the food and a hypothetical flash from drips of fat onto hot surfaces which can ignite and produce a brief flare-up. The flare-up shows up in the IR signal and the optical signal. The turning of the food and the flare-up show up in the HDF signal. The flow pass filtered (LPF) IR signal shows that the flare has a minimal effect because it is not sustained. Also the LPF signal may show very little fluctuation in the normal condition events. The optical signal is fairly smooth. A controller may discriminate a fire state from a cooking state by recognizing the lack of fluctuation in the LPF signal in that the flares are brief but in a fire, as discussed below, they may be larger and more sustained leading to a characteristic profile which may be easily recognized by a microprocessor and used to distinguish a fire state.

Figure 5:
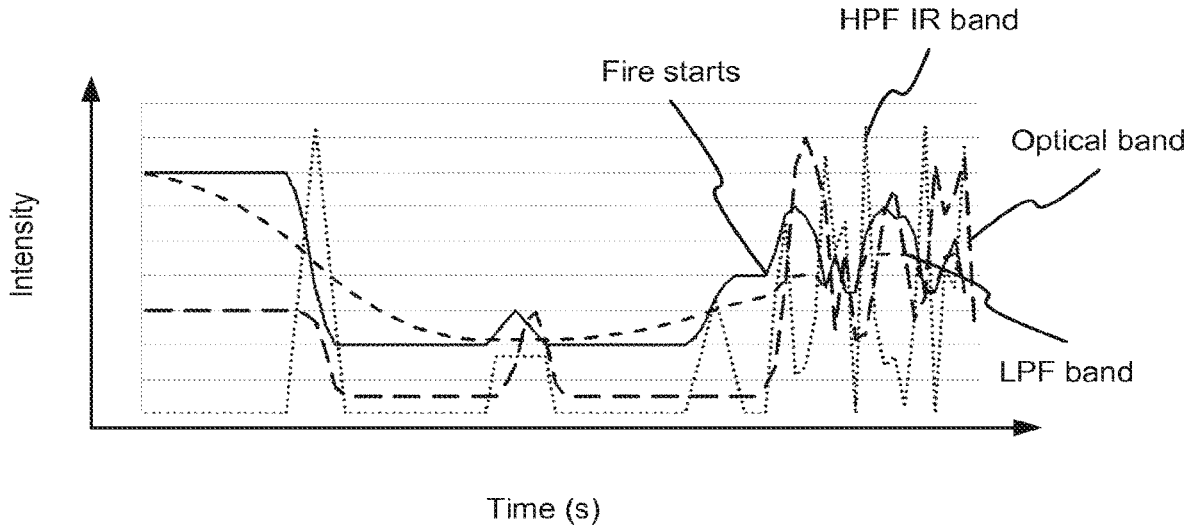
FIG. 5 illustrates, using simulated data, a time, light intensity profile for IR and optical bands filtered and unfiltered in a fire scenario.

Referring to FIG. 5, a fire starts as indicate in a cooking scenario which is otherwise identical to that of FIG. 4. As illustrated, the HPF IR signal fluctuates as does the LPF IR signal after the fire starts. The optical signal may show high levels for sustained or rapid sequence of intervals and fluctuations that are clearly different from a normal cooking state. Also notable is that the LPF IR signal rises and fluctuates. These features may be detected, in combination or independently, by a processor configured for pattern recognition or by thresholding the signal, in order to indicate a fire state.

The optical signal may be generated in the same manner as described herein with regard to the radiant temperature sensor. This can be a point luminance value or an image. The same goes for the IR signal which can provide radiant or luminance indications for many independent points in the field of view of a camera.

The cooking appliance 115 may have a cooking state, an idle state, a flare-up state, a fire state, and an OFF state. According to various embodiments, the method by which the cooking state, idle state and the OFF state and associated exhaust flow rates Q are determined is described in detail in the WO 2010/065793 application, attached herewith as United States Patent Application 20110284091.

For example, as shown in United States Patent Application 20110284091, the individual hood exhaust airflow (Q) may be controlled based on the appliance status (AS) or state, which may be, for example, AS=1, which indicates that the corresponding appliance is in a cooking state, AS=2, which indicates that the corresponding appliance is in an idle state, and AS=0, which indicates that the corresponding cooking appliance is turned off (OFF state). The exhaust temperature sensors 314 and the radiant IR sensors 312 may detect the appliance status and provide the detected status to the processor 304 of control module 302. Based on the reading provided by the sensors, the control module 302 may change the exhaust airflow (Q) in the system 100 to correspond to a predetermined airflow (Qdesign), a measured airflow (Q) (see below), and a predetermined (Qidle) airflow. When the detected cooking state is AS=1, the control module 302 may adjust the airflow (Q) to correspond to the predetermined (Qdesign) airflow. When the cooking state is AS=2, the control module 302 may adjust the airflow (Q) calculated according to the following equation:

$$Q = Qdesign\left(\frac{Tex - Tspace + dTspace}{T\max - Tspace + dTspace}\right)$$

And when the detected cooking state is AS=0, the control module 302 can adjust the airflow (Q) to be Q=0.

In particular, as shown in the United States Patent Application 20110284091, the cooking, idle, and OFF states may be determined based on the input received from the exhaust temperature sensors 314 and the IR temperature sensors 312. The exhaust temperature (Tex) and the ambient space temperature (Tspace) values may be read and stored in the memory 305 of the control module 302 in order to calculate the exhaust airflow (Q) in the system. The exhaust airflow (Q) may be calculated, for example, using the above shown equation. If the calculated exhaust airflow (Q) is less than the predetermined (Qidle) airflow, the cooking state may be determined to be AS=2 (idle state) and the exhaust airflow (Q) may be set to correspond to (Qidle). In this case, the fan may be kept at a speed (VFD) that maintains (Q)=(Qidle). If it is determined that the airflow (Q) exceeds the preset (Qidle) value, the appliance status is determined to be AS=1 (cooking state) and the control module 302 may set the fan speed (VFD) at (VFD)=(VFDdesign) to maintain the airflow (Q) at (Q)=(Qdesign).

The mean radiant temperature (IRT), as well as the fluctuation of the radiant temperature (FRT) emanating from the appliance cooking surface may also be measured using the IR detectors 312. If the processor 304 determines that the radiant temperature is increasing or decreasing faster than a pre-determined threshold, and the cooking surface is hot (IRT>IRTmin), then the appliance status is reported as AS=1 and the speed of fan (VFD) may be set to (VFDdesign). When the exhaust hood 105 is equipped with multiple IR sensors 312, by default, if either one of the sensors detects a fluctuation in the radiant temperature, then cooking state (AS=1) is reported. When the cooking state is detected, hood exhaust airflow (Q) may be set to design airflow (Q=Qdesign) for a preset cooking time (TimeCook) (7 minutes, for example). In at least one embodiment, this overrides control by exhaust temperature signal (Tex). Moreover, if the IR sensors 312 detect another temperature fluctuation within cooking time (TimeCook), the cooking timer is reset.

On the other hand, if the IR sensors 312 detect no temperature fluctuations within preset cooking time (TimeCook), the appliance status is reported as idle AS=2 and the fan speed may be modulated to maintain exhaust airflow at (Q)=(Q) calculated according to the equation above. When all IR sensors 312 detect (IRT<IRTmin) and (Tex<Tspace+dTspace), the appliance status is determined to be OFF (AS=0) and the exhaust fan is turned off by setting VFD=0. Otherwise, the appliance status is determined to be cooking (AS=2) and the fan speed (VFD) is modulated to keep the exhaust airflow (Q) at a level calculated according to the equation described above. The operation may end with the control module 302 setting the airflow (Q) at the airflow level based on the determined appliance status (AS).

Controlling the exhaust airflow in the system with motorized balancing dampers at the exhaust hood 105 may also be done. The controlling method may follow substantially similar steps as the above described method, except that when fluctuation in the radiant temperature (FRT) is detected by the IR sensors 312, or when the exhaust temperature (Tex) exceeds a minimum value (Tmin) the appliance status is determined to be AS=1 and the control module 302 additionally checks whether the balancing dampers are in a fully open position (BDP)=1, as well as whether the fan speed (VFD) is below a pre-determined design fan speed. If the conditions above are true, the fan speed (VFD) is increased until the exhaust flow Q reaches the design airflow (Qdesign). If the conditions above are not true, the fan speed (VFD) is maintained at (VFDdesign) and the airflow (Q) is maintained at (Q)=(Qdesign).

If there is no radiant temperature fluctuation or the exhaust temperature (Tex) does not exceed a maximum temperature (Tmax), the appliance status is determined to be the idle state AS=2. Additionally, the control module 302 may check whether the balancing dampers are in a fully opened position (BDP)=1 and whether the fan speed (VFD) is below the design fan speed. If the answer is yes, the fan speed (VFD) is increased and the balancing dampers are modulated to maintain the airflow (Q) at (Q)=(Q) (calculated according to the equation described above).

When there is no radiant temperature detected and the exhaust temperature is (Tex<Tspace+dTspace) the appliance status is determined to be AS=0 (OFF state), the balancing dampers are fully closed (BDP=0) and the fan is turned off. The appliance status may be stored if the exhaust temperature exceeds the ambient temperature. In the case that the appliance status is determined to be AS=2, the balancing dampers are modulated to keep the fan on to maintain the airflow of (Q)=(Q), which is calculated based on the above shown equation. The operation may then end and the exhaust airflow is set according to the determined appliance status.

In addition to the idle, cooking, and OFF states described above, as well as in United States Patent Application 20110284091, a flare-up state and a fire state of the cooking appliances may also be determined based on the exhaust temperature sensor 314, the IR radiant temperature sensor 312, and the pressure sensor 308 outputs. Using the IR sensors 312 and the pressure sensor 308, the instantaneous total radiant heat that emanates from the cooking appliances 115, as well as the rate of change of the radiant heat may be measured. Using the exhaust temperature sensor 314 output, the duration of the radiant heat gain may also be determined.

If the control module 302 determines that the measured total heat gain from the cooking appliances 115 is less than a predetermined threshold heat gain, or that the total heat gain is above the predetermined threshold heat gain and the duration of the heat gain is less than a predetermined threshold duration, it is determined that a flare-up during the regular cooking process has occurred. In this case, the appliance is in a flare-up state (AS=3). When a flare-up state is determined, an associate exhaust flow rate Q=Qflare-up is calculated, which is an exhaust flow rate that allows for the exhaust generated by the flare-up during cooking to be efficiently and successfully removed from the kitchen.

If the total heat gain is above the predetermined gain threshold and the duration of the heat gain is above the predetermined duration threshold, a fire status is detected. The appliance is in a fire state (AS=4). When the appliance status is indicated as being in a fire state, the control module 302 sends an activation signal to the fire suppression mechanism 400, which then determines whether to activate an alarm, and/or dispense fire extinguishing material through the nozzles 401.

Figure 2:
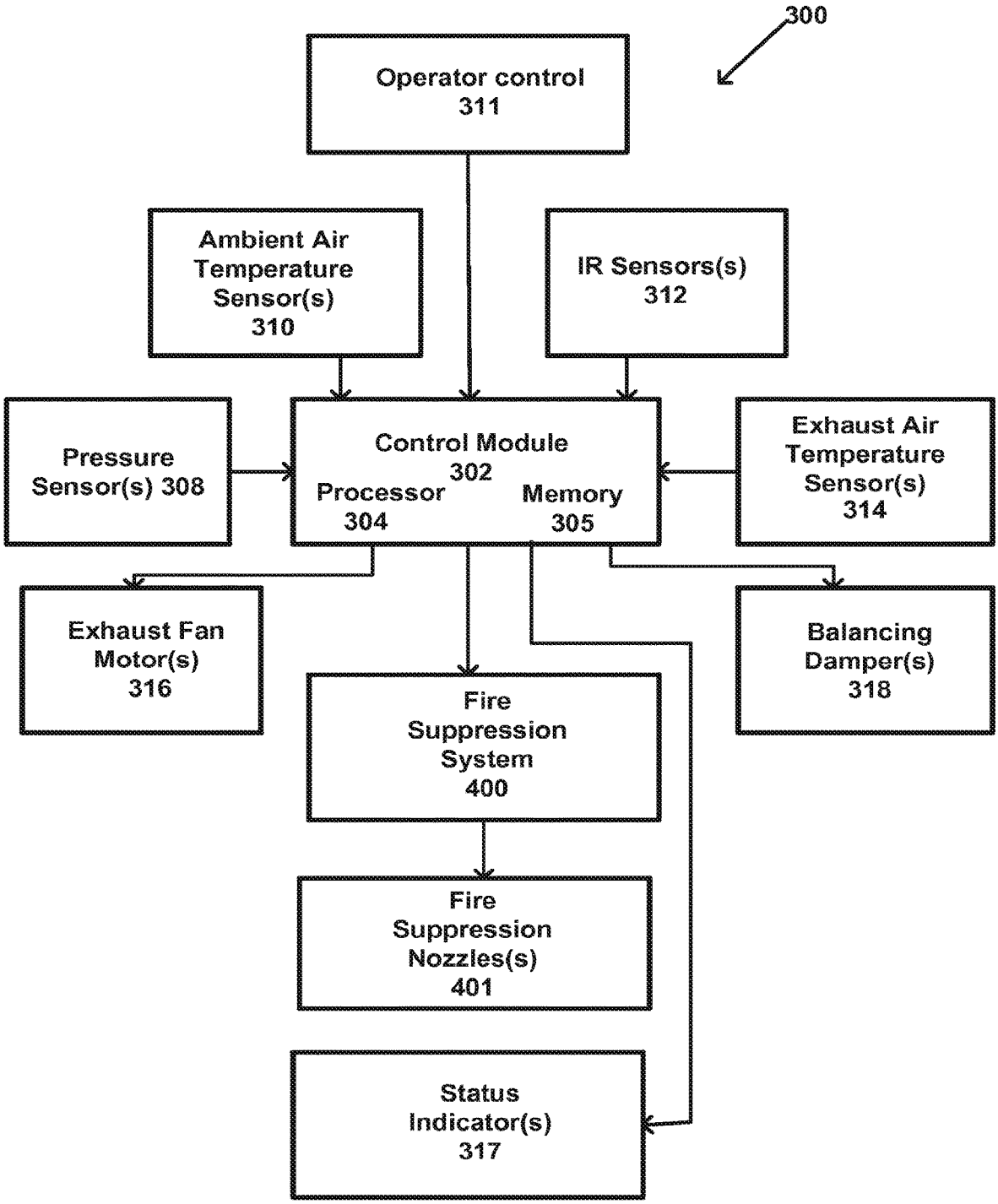
FIG. 2 is a block diagram of an exemplary exhaust air flow rate and fire suppression control system in accordance with the disclosure.

FIG. 2 shows a schematic block diagram of an exhaust flow rate control system 300 that may be used in connection with the above shown system 100. The exhaust flow control system 300 includes a control module 302. The control module 302 includes a processor 304 and a memory 305. The control module 302 is coupled to and receives inputs from a plurality of sensors and devices, including one or more IR sensors 312, which may be positioned on the exhaust hood canopy 105 so that the IR sensors 312 face the surface of the cooking appliances 115 and detect the radiant temperature emanating from the cooking surfaces, an exhaust air temperature sensor 314 installed close or in the exhaust plenum or the hood duct 110 to detect the temperature of the exhaust air that is sucked into the hood duct 110, an ambient air temperature sensor (not shown) positioned near the ventilation system 100 to detect the temperature of the air surrounding the cooking appliances 115, one or more pressure sensors 308, which may be positioned near a hood tab port (TAB) to detect the pressure built-up in the hood 105, and optional operator controls 311. Inputs from the sensors 308, 310, 314, 314 and operator controls 311 are transferred to the control module 302, which then processes the input signals and determines the appliance status (AS) or state. The control module processor 304 may control the speed of the exhaust fan motor(s) 316 and/or the position of the motorized balancing dampers 318 (BD) based on the appliance state. Each cooking state is associated with a particular exhaust flow rate (Q), as described in the WO 2010/065793 application, attached herewith as United States Patent Application 20110284091, as well as described above. Once the control module 302 determines the state that the appliance is in, it may then adjust the speed of the exhaust fan 316 and the position of the balancing dampers 318 to achieve a pre-determined air flow rate associated with each appliance state, such as cooking, idle, flare-up, and off states, or may activate the fire suppression mechanism 400 to dispense fire retardant material through the fire suppression nozzles 401 to extinguish the fire if a fire state is detected.

In various embodiments, the sensors may be operably coupled to the processor 304 using a conductive wire. The sensor outputs may be provided in the form of an analog signal (e.g. voltage, current, or the like). Alternatively, the sensors may be coupled to the processor 304 via a digital bus, in which case the sensor outputs may comprise one or more words of digital information. The number and positions of exhaust air temperature sensors 314 and radiant temperature sensors (IR sensors) 312 may be varied depending on how many cooking appliances and associated hoods, hood collars and hood ducts are present in the system, as well as other variables such as the hood length. The number and positioning of ambient air temperature sensors 310 may also be varied as long as the temperature of the ambient air around the ventilation system is detected. The number and positioning of the pressure sensors 308 may also be varied as long as they are installed in the hood duct in close proximity to the exhaust fan to measure the static pressure (Pst) in the main exhaust duct. All sensors are exemplary and therefore any known type of sensor may be used to fulfill the desired function. In general, the control module 302 may be coupled to sensors 308, 310, 312, 314, the fan motors 316, and dampers 318 by any suitable wired or wireless link.

In various embodiments, multiple control modules 302 may be provided. The type and number of control modules 302 and their location in the system may also vary depending on the complexity and scale of the system as to the number of above enumerated sensors and their locations within a system.

The control module 302 preferably contains a processor 304 and a memory 305, which may be configured to perform the control functions described herein. In various embodiments the memory 305 may store a list of appropriate input variables, process variables, process control set points as well as calibration set points for each hood. These stored variables may be used by the processor 304 during the different stages of the check, calibration, and start-up functions, as well as during operation of the system. Exemplary variables are described in United States Patent Application 20110284091.

In various embodiments, the processor 304 may execute a sequence of programmed instructions stored on a computer readable medium (e.g., electronic memory, optical or magnetic storage, or the like). The instructions, when executed by the processor 304, may cause the processor 304 to perform the functions described herein. The instructions may be stored in the memory 305, or they may be embodied in another processor readable medium, or a combination thereof. The processor 304 may be implemented using a microcontroller, computer, an Application Specific Integrated Circuit (ASIC), or discrete logic components, or a combination thereof.

In various embodiment, the processor 304 may also be coupled to a status indicator or display device 317, such as, for example, a Liquid Crystal Display (LCD), for output of alarms and error codes and other messages to a user. The indicator 317 may also include an audible indicator such as a buzzer, bell, alarm, or the like.

Figure 3:
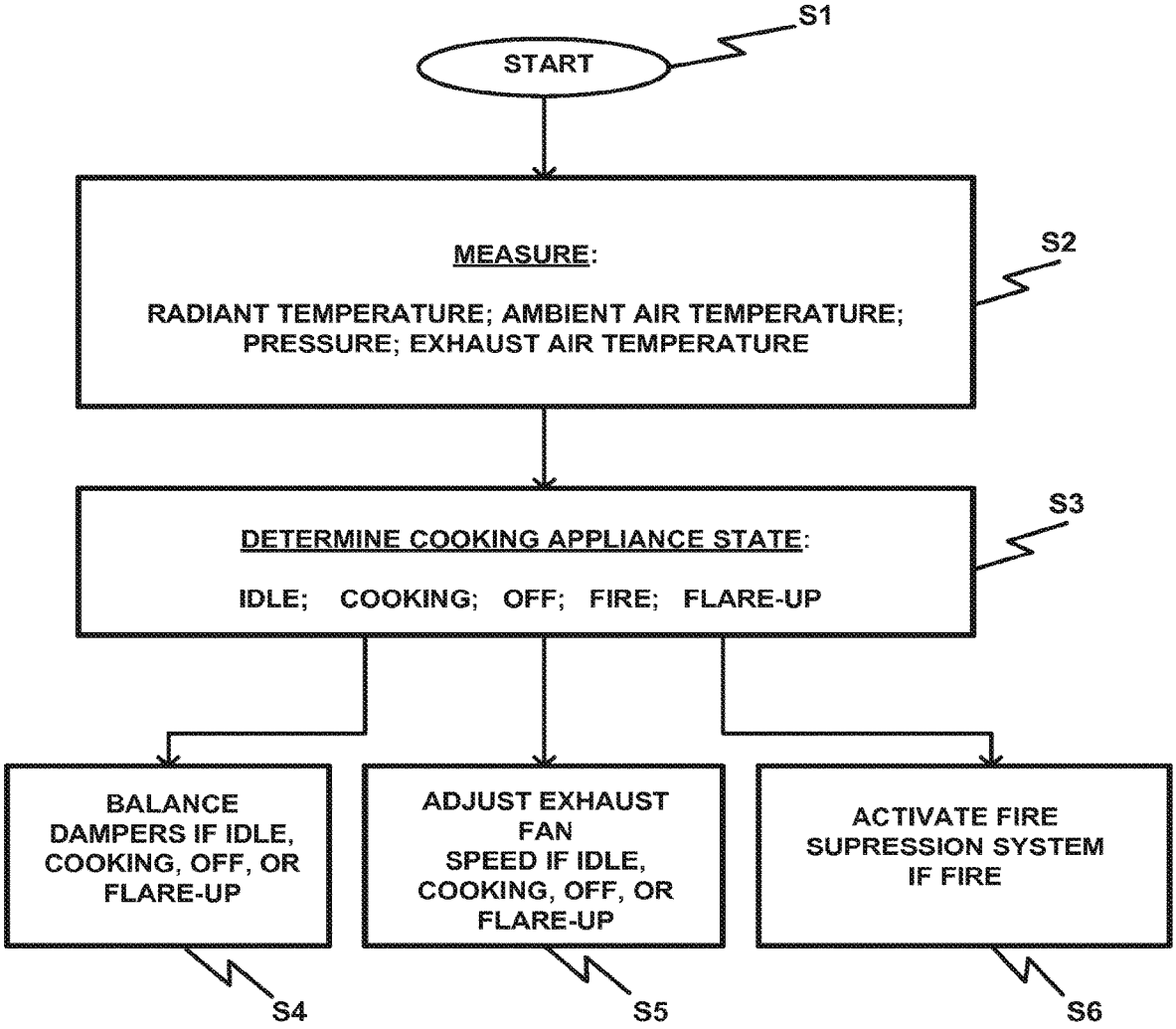
FIG. 3 is a flow diagram of an exemplary operation routine according to various embodiments.

In operation, as shown in FIG. 3, in an exemplary embodiment, the control module 302 starts a control operation in S I directing sensor(s) 312 in S2 to measure the radiant temperature, sensor 314 to measure the exhaust air temperature, sensor 310 to measure the ambient air temperature, and sensor 308 to measure the pressure in the hood 105. Optionally, the control module 302 also directs other temperature sensors positioned near the cooking appliances 115 to measure the cooking temperature. In S3, the control module 302 receives an exhaust air temperature input, a pressure sensor input, an ambient air temperature input, and an infrared sensor input. The control module 302 then determines in S3 the appliance state based on the sensor inputs. The control module 302 also determines in S3 the current exhaust flow rate (Q). The current exhaust flow rate is then compared to a desired exhaust flow rate associated with an appliance state. If the determined exhaust flow rate is the desired exhaust flow rate, control restarts. If the determined exhaust flow rate is not the desired exhaust flow rate, control proceeds to determining the damper(s) position or the exhaust fan speed based on the determined appliance state. If the determined appliance state is one of a cooking state, idle state, OFF state, or flare-up state, the control module 302 proceeds to output a damper position command to the damper(s) in S4, or an output speed command to the exhaust fan in S5, to regulate the exhaust flow rate based on the determined appliance status. If the determined appliance state is the fire state, the control module 302 sends an activation signal to the fire suppression mechanism 400 in S6, which then determines whether to activate an alarm, and/or dispense fire extinguishing material through the nozzles 401.

The control may then proceed to determine whether the power of the cooking appliance is off, in which case the control ends, or to start the control again if power is determined to still be on.

In another embodiment, a system includes a control module 302 coupled to the sensors and control outputs (not shown). The control module 302 is also coupled to an alarm interface (not shown), a fire suppression interface (not shown), and an appliance communication interface (not shown). The alarm interface is coupled to an alarm system. The fire suppression interface is coupled to a fire suppression mechanism 400. The appliance communication interface is coupled to one or more appliances 115.

In operation, the control module 302 may communicate and exchange information with the alarm system, fire suppression mechanism 400, and appliances 115 to better determine appliance states and a suitable exhaust flow rate. Also, the control module 302 may provide information to the various systems so that functions may be coordinated for a more effective operational environment. For example, the control module 302, through its sensors, may detect a fire or other dangerous condition and communicate this information to the alarm system, the fire suppression mechanism 400, and the appliances 115 so that each device or system may take appropriate actions. Also, information from the appliances 115 may be used by the exhaust flow control system to more accurately determine appliance states and provide more accurate exhaust flow control.

In an embodiment, before operation, the system 100 may also be checked and calibrated by the control module 302 during the starting process, in order to balance each hood to a preset design and idle exhaust flow rate, to clean and recalibrate the sensors, if necessary, and to evaluate each component in the system for possible malfunction or breakdown. The appropriate alarm signals may be displayed on an LCD display in case there is a malfunction in the system, to inform an operator of the malfunction and, optionally, how to recover from the malfunction. An exemplary calibration process is described in detail in United States Patent Application 20110284091.

For example, a routine may be performed by the control module 302 to check the system 100 before the start of the flow control operation. The routine may start with a control module self-diagnostics process. If the self-diagnostic process is OK, the control module 302 may set the variable frequency drive (VFD) which controls the exhaust fan speed to a preset frequency (VFDidle). Then the static pressure may be measured by a pressure transducer positioned at the hood TAB port and the exhaust flow may be set to (Q) calculated using the formula above. If the self-diagnostics process fails, the control module 302 may verify whether the (VFD) is the preset (VFDidle) and whether the exhaust air flow (Q) is less or exceeds (Qidle) by a threshold airflow coefficient. Based on the exhaust airflow reading, the control module 302 generates and outputs appropriate error codes, which may be shown or displayed on an LCD display or other appropriate indicator 317 attached to the exhaust hood or coupled to the control module 302.

In another embodiment, if the exhaust flow (Q) is less than (Qidle) by a filter missing coefficient (Kfilter missing) then the error code "check filters and fan" may be generated. If, on the other hand, the exhaust flow (Q) exceeds (Qidle) by a clogged filter coefficient (Kfilter clogged), then a "clean filter" alarm may be generated. If the exhaust flow (Q) is in fact the same as (Qidle) then no alarm is generated, and the routine ends.

In another embodiment, a routine may be performed by the control module 302 to check the system. The routine may start with a self-diagnostics process. If a result of the self-diagnostic process is OK, the control module 302 may maintain the exhaust air flow (Q) at (Qidle) by maintaining the balancing dampers in their original or current position. Then, the static pressure (dp) is measured by the pressure transducer positioned at the hood TAB port, and the exhaust flow is set to (Q) calculated using the exhaust flow rate equation. If the self-diagnostics process fails, the control module may set the balancing dampers (BD) at open position and (VFD) at (VFDdesign).

The control module 302 may then check whether the balancing dampers are malfunctioning. If there is a malfunctioning balancing damper, the control module 302 may open the balancing dampers. If there is no malfunctioning balancing damper, then the control module 302 may check whether there is a malfunctioning sensor in the system. If there is a malfunctioning sensor, the control module 302 may set the balancing dampers at (BDPdesign), the (VFD) at (VFDdesign) and the exhaust airflow to (Qdesign). Otherwise, the control module 302 may set (VFD) to (VFDidle) until the cooking appliance is turned off. This step terminates the routine.

In various embodiments, the hood 105 may automatically be calibrated to design airflow (Qdesign). The calibration procedure may be activated with all ventilation systems functioning and cooking appliances in the off state. The calibration routine may commence with the fan turned off. If the fan is turned off, the hood may be balanced to the design airflow (Qdesign). If the hood is not balanced, the control module 302 may adjust VFD until the exhaust flow reaches (Qdesign). The routine then waits until the system is stabilized. Then, the hood 105 may be balanced for (Qidle) by reducing (VFD) speed. The routine then again waits until the system is stabilized.

In another embodiment, the sensor may also be calibrated. The calibration of the sensors may be done during a first-time calibration mode, and is performed for cold cooking appliances and when there are no people present under the hood. The radiant temperature (IRT) may be measured and compared to a thermostat reading (Tspace), and the difference may be stored in the control module 302 memory 305 for each of the sensors. During subsequent calibration procedures or when the exhaust system is off, the change in the radiant temperature is measured again and is compared to the calibrated value stored in the memory 305. If the reading is higher than a maximum allowed difference, a warning is generated in the control module 302 to clean the sensors. Otherwise the sensors are considered calibrated and the calibration routine is terminated.

For a system with multiple hoods, one fan and no motorized balancing dampers, the calibration routine may follow substantially the same steps as for a single hood, single fan, and no motorized damper system shown above, except that every hood is calibrated. The routine starts with Hood 1 and follows hood balancing steps as shown above, as well as sensor calibration steps as shown above.

Once the first hood is calibrated, the airflow for the next hood is verified. If the airflow is at set point (Qdesign), the sensor calibration is repeated for the second (and any subsequent) hood. If the airflow is not at the set point (Qdesign), the airflow and the sensor calibration may be repeated for the current hood. The routine may be followed until all hoods in the system are calibrated. The new design airflows for all hoods may be stored in the memory 305.

An automatic calibration routine may also be performed. During the calibration routine all hoods are calibrated to design airflow (Qdesign) at minimum static pressure. The calibration procedure may be activated during the time the cooking equipment is not planned to be used with all hood filters in place, and repeated regularly (once a week for example). After the calibration routine is activated, the exhaust fan may be set at maximum speed VFD=1 (VFD=1—full speed; VFD=0—fan is off) and all balancing dampers fully opened (BDP=1—fully open; BDP=0—fully closed). The exhaust airflow may be measured for each hood using the TAB port pressure transducer (PT). In various embodiments each hood may be balanced to achieve the design airflow (Qdesign) using the balancing dampers. At this point, each BDP may be less than 1 (less than fully open). There may also be a waiting period in which the system stabilizes.

If the exhaust airflow is not at (Qdesign), the VFD setting is reduced until one of the balancing dampers is fully open. In at least one embodiment, this procedure may be done in steps by gradually reducing the VFD setting by 10% at each iteration until one of the dampers is fully open and the air flow is (Q)=(Qdesign). If, on the other hand, the airflow is Q=(Qdesign), the pressure transducer setting in the main exhaust duct (Pstdesign), the fan speed VFDdesign, and the balancing damper position BDPdesign settings may be stored, and the calibration is finished.

After calibration, which may or may not need to be done, infrared sensors 312, for example, measure the radiant temperature (IRT) of the cooking surface of any of the at least one cooking appliance 115, the ambient air temperature sensor 310 measures the temperature of the space around the cooking appliance, another temperature sensor may measure the cooking temperature, the pressure sensor 308 measures the pressure in the hood, and the exhaust temperature sensor 314 measures the temperature in the exhaust hood. The control module 302 then determines the status of the cooking appliance based on the measured temperatures and pressure. The system and method by which the cooking states, such as the off, idle, and cooking states and associated exhaust air flows (Q) are determined are included in WO 2010/065793 attached herewith as United States Patent Application 20110284091. The flare-up and fire states and associated exhaust air flows (Q) and/or actions to be taken are determined using the system as described herein and in the attached United States Patent Application 20110284091.

According to first embodiments, the disclosed subject matter includes a method of detecting a condition in an exhaust ventilation system including an exhaust hood, the method comprising. The method includes receiving, at a control module, an exhaust air temperature signal representing a temperature of the exhaust air in a vicinity of the exhaust hood, the exhaust air temperature signal being generated by a temperature sensor. The method further includes receiving, at the control module, a radiant temperature signal representing a temperature of a surface of a cooking appliance that generates the exhaust air, the radiant temperature signal being generated by a radiant temperature sensor. The method further includes receiving, at the control module, a pressure signal representing the pressure in the hood. The method further includes regulating a flow of exhaust to a first flow rate associated with an idle status of the cooking appliance responsively to the received exhaust air temperature signal, the received radiant temperature signal, and the received pressure signal. The method further includes regulating a flow of exhaust to a second high flow rate, higher than the first low flow rate, associated with an high load cooking status of the cooking appliance responsively to the received exhaust air temperature signal, the received radiant temperature signal, and the received pressure signal and regulating a fire suppression mechanism responsively to at least one of the received exhaust air temperature signal, the received radiant temperature signal, and the received pressure signal.

According to variations of the first embodiments, the disclosed subject matter includes further first embodiments that include, using the control module, and responsively to the radiant temperature, exhaust temperature, and a further signal, distinguishing a flare-up from a grill from a fire and regulating a flow rate of the exhaust and/or regulating a fire suppression mechanism responsively to the distinguishing. According to variations of the first embodiments, the disclosed subject matter includes further first embodiments in which the further signal includes an optical luminance signal. According to variations thereof, the disclosed subject matter includes further first embodiments in which the distinguishing includes filtering an optical or radiant temperature signal so as to detect a temporal fluctuation and employing machine classification to recognize distinguish at least two cooking states and a fire state. According to variations thereof, the disclosed subject matter includes further first embodiments in which the fire suppression mechanism is activated in response to the calculation by the control module of a total heat gain above the predetermined magnitude threshold combined with a duration of the heat gain being above a predetermined duration threshold. According to variations thereof, the disclosed subject matter includes further first embodiments in which the control module includes a processor and a memory with a program stored in the memory adapted for implementing a machine classification algorithm and to control the exhaust flow and fire suppression mechanism responsively to a classifier output thereof. According to variations thereof, the disclosed subject matter includes further first embodiments in which the pressure signal is indicative of a flow rate through the exhaust hood. According to variations thereof, the disclosed subject matter includes further first embodiments in which the regulating a flow of exhaust includes regulating a flow of exhaust responsively to the pressure signal.

According to second embodiments, the disclosed subject matter includes a method of responding to a condition in an exhaust ventilation system including an exhaust hood, the method comprising. The method includes regulating a flow of exhaust through a ventilation component responsively to a first sensor adapted to detect a fume load from a cooking appliance and detecting a fire condition responsively to the first sensor and regulating a fire suppression mechanism responsively to the detecting. The regulating and detecting are performed by a controller configured to receive signals from the sensor.

According to variations thereof, the disclosed subject matter includes further second embodiments in which the ventilation component includes a cooking exhaust hood. According to variations thereof, the disclosed subject matter includes further second embodiments in which the controller includes a digital processor adapted for distinguishing first and second fume load states and for generating a command signal respective to each of the exhaust flow rates. According to variations thereof, the disclosed subject matter includes further second embodiments in which the digital processor implements a machine classification algorithm. According to variations thereof, the disclosed subject matter includes further second embodiments in which the digital processor implements a machine classification algorithm generated from a supervised learning. According to variations thereof, the disclosed subject matter includes further second embodiments in which According to variations thereof, the disclosed subject matter includes further second embodiments in which the digital processor implements an algorithm that is responsive to whether the first signal is temporally fluctuating or not and for regulating the flow of exhaust responsively thereto. According to variations thereof, the disclosed subject matter includes further second embodiments in which the first sensor includes a radiant temperature sensor or an air temperature sensor. According to variations thereof, the disclosed subject matter includes further second embodiments in which the first sensor includes a camera. According to variations thereof, the disclosed subject matter includes further second embodiments in which the camera is able to image in infrared wavelengths. According to variations thereof, the disclosed subject matter includes further second embodiments in which the camera is able to image in optical wavelengths. According to variations thereof, the disclosed subject matter includes further second embodiments in which According to variations thereof, the disclosed subject matter includes further second embodiments in which the camera is able to image in infrared and optical wavelengths. According to variations thereof, the disclosed subject matter includes further second embodiments that include low pass filtering the signal from the first sensor, wherein and the regulating is responsive both the signal from the first sensor and a result of the low pass filtering.

According to third embodiments, the disclosed subject matter includes a method of detecting a condition in an exhaust ventilation system including an exhaust hood. The method includes receiving, at a control module, an exhaust air temperature signal representing a temperature of the exhaust air in a vicinity of the exhaust hood, the exhaust air temperature signal being generated by a temperature sensor and receiving, at the control module, a radiant temperature signal representing a temperature of a surface of a cooking appliance that generates the exhaust air, the radiant temperature signal being generated by a radiant temperature sensor. The method also includes receiving, at the control module, a pressure signal representing the pressure in the hood and determining in the control module a state of the cooking appliance responsively to the received exhaust air temperature signal, the received radiant temperature signal, and the received pressure signal. The method further includes determining a fire condition in response to the determined appliance state.

According to variations thereof, the disclosed subject matter includes further third embodiments in which the cooking appliance state includes a cooking state, an idle state, an off state, a flare-up state, and a fire state and the control modules is configured to generate a respective control signal for each of the detected states and the method includes regulating an exhaust flow rate and a fire suppression mechanism responsively to the respective control signals. According to variations thereof, the disclosed subject matter includes further third embodiments that include using the control module, and responsively to the radiant temperature, exhaust temperature, and a further signal, distinguishing a flare-up from a grill from a fire and regulating a flow rate of the exhaust and/or regulating a fire suppression mechanism responsively to the distinguishing. According to variations thereof, the disclosed subject matter includes further third embodiments in which the further signal includes an optical luminance signal. According to variations thereof, the disclosed subject matter includes further third embodiments in which the distinguishing includes filtering an optical or radiant temperature signal so as to detect a temporal fluctuation and employing machine classification to recognize distinguish at least two cooking states and a fire state. According to variations thereof, the disclosed subject matter includes further third embodiments in which the fire suppression mechanism is activated in response to the calculation by the control module of a total heat gain above the predetermined magnitude threshold combined with a duration of the heat gain being above a predetermined duration threshold. According to variations thereof, the disclosed subject matter includes further third embodiments in which the control module includes a processor and a memory with a program stored in the memory adapted for implementing a machine classification algorithm and to control the exhaust flow and fire suppression mechanism responsively to a classifier output thereof.

The disclosed embodiments include systems configured to implement any of the foregoing methods.

The disclosed embodiments include systems including an exhaust hood configured to implement any of the foregoing methods.

The disclosed embodiments include systems including an exhaust hood and a controller configured to implement any of the foregoing methods.

According to fourth embodiments, the disclosed subject matter includes a combined fire suppression and exhaust flow control system. A controller has at least one first sensor, the controller being configured to generate a exhaust flow rate command signal for controlling an exhaust flow rate responsively to a signal from the first sensor. The controller is further configured to generate a fire suppression command signal for controlling a fire suppression mechanism responsively to a signal from the first sensor.

According to variations thereof, the disclosed subject matter includes further fourth embodiments that include an exhaust fan-speed drive connected to the controller so as to receive the exhaust flow rate command signal. According to variations thereof, the disclosed subject matter includes further fourth embodiments in which the first sensor. According to variations thereof, the disclosed subject matter includes further fourth embodiments that include a cooking exhaust hood. According to variations thereof, the disclosed subject matter includes further fourth embodiments in which the controller includes a digital processor adapted for distinguishing first and second fume load states and for generating a command signal respective to each of the exhaust flow rates. According to variations thereof, the disclosed subject matter includes further fourth embodiments in which the digital processor implements a machine classification algorithm. According to variations thereof, the disclosed subject matter includes further fourth embodiments in which the digital processor implements a machine classification algorithm generated from a supervised learning. According to variations thereof, the disclosed subject matter includes further fourth embodiments in which the digital processor implements an algorithm that is responsive to whether the first signal is temporally fluctuating or not and for regulating the flow of exhaust responsively thereto. According to variations thereof, the disclosed subject matter includes further fourth embodiments in which the first sensor includes a radiant temperature sensor or an air temperature sensor. According to variations thereof, the disclosed subject matter includes further fourth embodiments in which the first sensor includes a camera. According to variations thereof, the disclosed subject matter includes further fourth embodiments in which the camera is able to image in infrared wavelengths. According to variations thereof, the disclosed subject matter includes further fourth embodiments in which the camera is able to image in optical wavelengths. According to variations thereof, the disclosed subject matter includes further fourth embodiments in which the camera is able to image in infrared and optical wavelengths.

Embodiments of a method, system and computer program product for controlling exhaust flow rate, may be implemented on a general-purpose computer, a special-purpose computer, a programmed microprocessor or microcontroller and peripheral integrated circuit element, an ASIC or other integrated circuit, a digital signal processor, a hardwired electronic or logic circuit such as a discrete element circuit, a programmed logic device such as a PLD, PLA, FPGA, PAL, or the like. In general, any process capable of implementing the functions or steps described herein may be used to implement embodiments of the method, system, or computer program product for controlling exhaust flow rate.

Furthermore, embodiments of the disclosed method, system, and computer program product for controlling exhaust flow rate may be readily implemented, fully or partially, in software using, for example, object or object-oriented software development environments that provide portable source code that may be used on a variety of computer platforms.

Alternatively, embodiments of the disclosed method, system, and computer program product for controlling exhaust flow rate may be implemented partially or fully in hardware using, for example, standard logic circuits or a VLSI design. Other hardware or software may be used to implement embodiments depending on the speed and/or efficiency requirements of the systems, the particular function, and/or a particular software or hardware system, microprocessor, or microcomputer system being utilized. Embodiments of the method, system, and computer program product for controlling exhaust flow rate may be implemented in hardware and/or software using any known or later developed systems or structures, devices and/or software by those of ordinary skill in the applicable art from the functional description provided herein and with a general basic knowledge of the computer, exhaust flow, and/or cooking appliance arts.

Moreover, embodiments of the disclosed method, system, and computer program product for controlling exhaust flow rate may be implemented in software executed on a programmed general-purpose computer, a special purpose computer, a microprocessor, or the like. Also, the exhaust flow rate control method of this invention may be implemented as a program embedded on a personal computer such as a JAVA® or CGI script, as a resource residing on a server or graphics workstation, as a routine embedded in a dedicated processing system, or the like. The method and system may also be implemented by physically incorporating the method for controlling exhaust flow rate into a software and/or hardware system, such as the hardware and software systems of exhaust vent hoods and/or appliances.

It is, therefore, apparent that there is provided in accordance with the present invention, a method, system, and computer program product for controlling exhaust flow rate, determining a fire condition, and suppressing the fire if a fire condition is detected. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

The invention claimed is:

1. A method of responding to a condition in an exhaust ventilation system, the method comprising:

providing a camera positioned to detect conditions of a cooking appliance and configured to detect both IR color and optical bands and to output at least one signal;

receiving the at least one signal from the camera by a controller;

detecting by the controller a fire condition responsively to the at least one signal received from the camera; and regulating by the controller a fire suppression mechanism responsively to the detecting.

2. The method of claim 1, wherein the exhaust ventilation system includes a cooking exhaust hood.

3. The method of claim 1, further comprising:

digitally processing images included in the at least one signal output by the camera to identify a fire and distinguish the fire from a hot grill.

4. The method of claim 1, wherein the camera produces a color channel of a video signal, thereby enabling a single video stream to indicate temperature and luminance at multiple locations in real time.

5. The method of claim 1, wherein the controller implements a machine classification algorithm.

6. The method of claim 5, wherein the controller implements a machine classification algorithm generated from a supervised learning.

7. The method of claim 1, further comprising:

reducing dimensionality of the signal from the camera as an input for training and recognizing fire and cooking events.

8. The method of claim 1, wherein the controller implements an algorithm that is responsive to whether said signal from the camera is temporally fluctuating or not and for regulating a flow of exhaust responsively thereto.

9. A combined fire suppression and exhaust flow control system, comprising:

a controller receiving at least a first signal from at least a camera, the controller being configured to generate an exhaust flow rate command signal for controlling an exhaust flow rate responsively to the first signal from the camera; and the camera positioned to detect conditions of a cooking appliance and configured to detect both IR color and optical bands and to output the first signal, wherein the controller is further configured to generate a fire suppression command signal for controlling a fire suppression mechanism responsively to at least the first signal from the camera.

10. The system of claim 9, further comprising an exhaust fan-speed drive connected to the controller so as to receive the exhaust flow rate command signal.

11. The system of claim 9, further comprising a cooking exhaust hood.

12. The system of claim 9, wherein the controller includes a digital processor adapted for distinguishing first and second fume load states and for generating a command signal selecting an exhaust flow rate respective to each of the fume load states.

13. The system of claim 12, wherein the digital processor implements a machine classification algorithm.

14. The system of claim 13, wherein the digital processor implements a machine classification algorithm generated from a supervised learning.

15. The system of claim 13, wherein the digital processor implements an algorithm that is responsive to whether said first signal is temporally fluctuating or not and for regulating the exhaust flow rate responsively thereto.

* * * * *